US007357433B2

(12) United States Patent
Hess et al.

(10) Patent No.: US 7,357,433 B2
(45) Date of Patent: Apr. 15, 2008

(54) SLING BAND FOR LIFTING LOADS

(75) Inventors: Ruedi Hess, Tegerfelden (CH); Joop Colijn, Thörishaus (CH)

(73) Assignee: mamutec AG, Zug (CH)

( * ) Notice: Subject to any disclaimer, the term of this patent is extended or adjusted under 35 U.S.C. 154(b) by 29 days.

(21) Appl. No.: 10/450,817

(22) PCT Filed: Dec. 20, 2001

(86) PCT No.: PCT/CH01/00730

§ 371 (c)(1),
(2), (4) Date: Oct. 29, 2003

(87) PCT Pub. No.: WO02/49952

PCT Pub. Date: Jun. 27, 2002

(65) Prior Publication Data

US 2004/0094981 A1 May 20, 2004

(30) Foreign Application Priority Data

Dec. 20, 2000 (CH) ..... 2483/00

(51) Int. Cl.
*B66C 1/12* (2006.01)

(52) U.S. Cl. ..... 294/74

(58) Field of Classification Search ..... 294/74, 294/75, 76, 77

See application file for complete search history.

(56) References Cited

U.S. PATENT DOCUMENTS 3,290,083 A * 12/1966 Norton ..... 294/74
3,368,837 A * 2/1968 Norton ..... 294/74
3,463,534 A * 8/1969 Norton ..... 294/74
3,466,080 A * 9/1969 Norton ..... 294/74
4,022,507 A * 5/1977 Marino ..... 294/74
4,052,095 A * 10/1977 Johnson ..... 294/74
4,174,738 A 11/1979 Berger et al.
4,200,325 A * 4/1980 Johnson ..... 294/74
4,856,837 A 8/1989 Hammersla, Jr.
5,238,279 A * 8/1993 Anteau ..... 294/74
5,415,449 A * 5/1995 Kentner, Sr. ..... 294/74
5,419,951 A * 5/1995 Golz ..... 294/74
5,492,383 A * 2/1996 Kentner, Sr. ..... 294/74
5,498,047 A 3/1996 Treuling
6,331,024 B1 * 12/2001 Gulley ..... 294/74

* cited by examiner

*Primary Examiner*—Peter M. Cuomo
*Assistant Examiner*—Paul T Chin
(74) *Attorney, Agent, or Firm*—Buchanan Ingersoll & Rooney PC

(57) ABSTRACT

A sling band for lifting loads is disclosed. The sling band has a first band, a second band and overlapping areas, whereby the ends of the bands lead into the overlapping areas. The first band includes first warp threads and the second band includes second warp threads, whereby the warp threads, together with weft threads, form a first and a second weave. In the overlapping areas, the warp threads are joined to one another where they form a web construction with the weft threads. The web construction includes at least one additional third weave that differs from the first and second weaves. A portion of the warp threads has a lower melting point than that of the remaining warp threads thus enabling the interwoven overlapping areas to be provided with increased strength using a weld.

8 Claims, 3 Drawing Sheets

SLING BAND FOR LIFTING LOADS

FIELD OF THE INVENTION

The invention relates to a lifting sling according to claim 1 and also the use thereof according to claims 6-8.

Lifting slings find application in transportation and particularly in the building industry.

BACKGROUND OF THE INVENTION

Woven single layer or double-layer endless lifting slings are used in large quantities for lifting loads, according to European Standards EN 1492-1 (Safety: Requirements for flat-woven lifting slings of synthetic fibers) and EN 1492-2 (Safety: Requirements for round slings of synthetic fibers). FIG. 1 shows a view of a known, single-layer endless lifting sling according to EN 1492-1. These textile bands are sewn together so that they overlap, thus acquiring the suitable delivery form for the user.

According to U.S. Pat. No. 5,498,047, a textile, abrasion resistant lifting sling is known, in which the superposed woven zones are sewn together.

The very work-intensive sewing processes are disadvantageous there, and the original strength of the sling is thereby reduced. For this reason, the strength of the sling used has to be chosen considerably higher than would be prescribed for the application provided. Investigations have shown that a replacement of the sewing process by welding or adhesion is seriously faulty for safety reasons. Bonding has been accepted in only a few uses in which strength or breaking load plays a subordinate part. Weld seams on textile bands have the disadvantage that a weakening of the material occurs directly adjacent to the weld seam to a greater or lesser extent.

It is furthermore known that several woven layers can be woven directly one above another with so-called needle looms for textile bands. The connection between the fabric layers, however, has up to now been found to be unsuitable for use in lifting slings. It has now surprisingly been found that a suitable overlapping of two woven fabric layers woven one above the other and a special woven construction according to the invention can lead to a suitable and reliable breaking load for endless lifting slings.

SUMMARY OF THE INVENTION

The present invention has as its object to propose a lifting sling in which a sewing process can be dispensed with, so that the said disadvantages are remedied.

A further object consists of describing different uses for such lifting slings.

According to the invention this object is attained with a lifting sling according to the wording of claim 1 and with uses according to the wording of claims 6-8.

BRIEF DESCRIPTION OF THE DRAWINGS

The invention is explained in detail using the accompanying drawing.

DETAILED DESCRIPTION OF THE INVENTION

Figure 1:
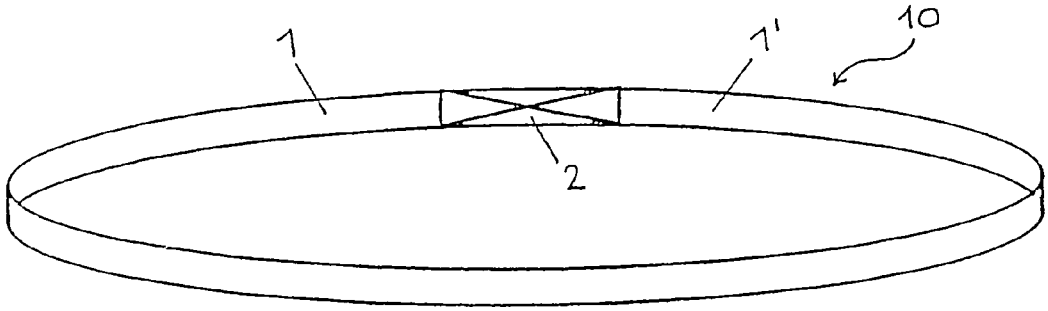
Prior Art Fig. 1
FIG. 1 shows a perspective view of a known, single-layer endless lifting sling

FIG. 1 shows a perspective view of a known, single-layer endless lifting sling. The two ends 1 and 1' of a sling 10 are superposed in an overlapping region 2 and are sewn together, which can take place in many different ways.

Figure 2:
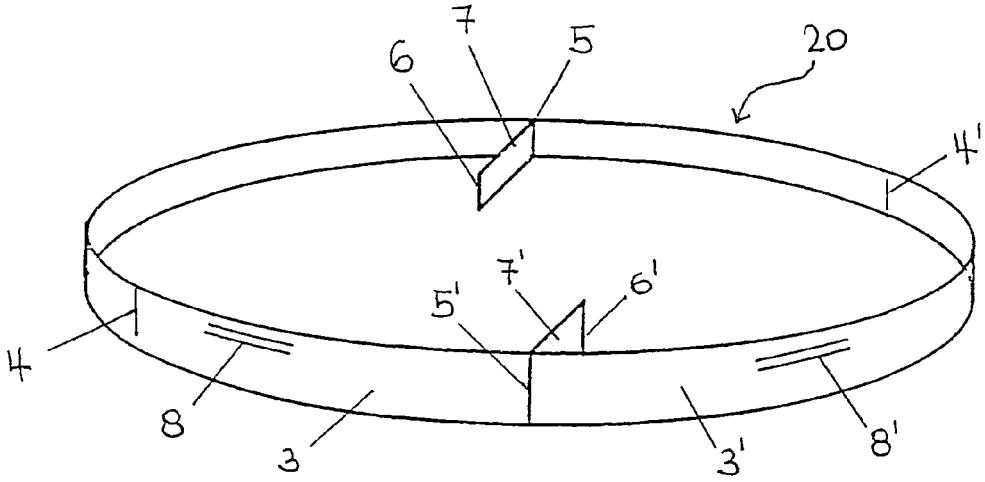
FIG. 2 shows a perspective view of an endless lifting sling according to the invention

FIG. 2 shows a perspective view of an endless lifting sling according to the invention after it is woven and cut off. A band 20 consists of two layers 3 and 3', which were woven as a two-layer band, the weaving locations 4 and 4' being superposed during weaving. The band 20 has a weaving location 5 from which the two warp sheets of the layers 3 and 3' are united, whereby an overlapping region 7 of the warp sheets results as far as a further weaving location 6, in which the two warp sheets are present, woven together by means of a special woven construction. The first band 3 has a first warp yarn 8, and the second band 3' has a second warp yarn 8', the warp yarns 8 and 8' forming with weft yarns a first and a second weave. In the overlapping regions 7, 7', the warp yarns 8, 8' are brought together where they form with the weft yarn a woven construction which has at least a further third weave, differing from the first and second weaves. A two-layer band arises in this manner in the overlapping region 7 and is distinguished by its particular strength. The weaving location 6 is at the same time also a cutting place at which the band is cut. In an analogous manner, the band 20 has a weaving location 5', a weaving location 6', and an overlapping region 7', with the difference that the weaving process beginning at weaving location 6' first produces a two-layer band in the overlapping region 7', in order then to further weave two layers at the weaving location with divided warp sheets, giving rise to layers 3 and 3'. The endless lifting sling according to the invention thus arises by simple cutting off or separation from an endless woven product which consists alternately of a two-layer band 3, 3' and single-layer overlapping regions 7, 7'. Since the woven constructions used in the overlapping regions 7, 7' are more than sufficiently strong, endless lifting slings may thus be produced in an advantageous manner, avoiding any sewing process. If a yarn with a lower melting point than that of the other warp yarns is chosen for a portion of the warp yarns 8, 8', increased strength can be attained by bonding in the woven overlapping regions 7, 7'.

Figure 3:
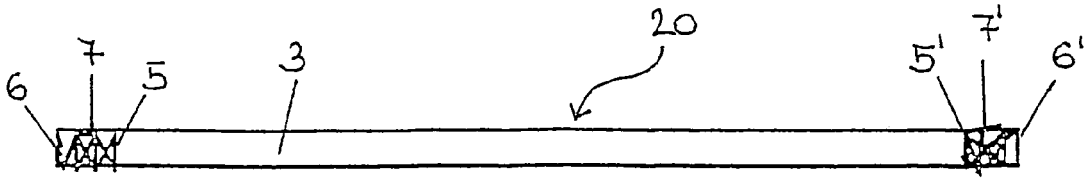
FIG. 3 shows a plan view of an endless lifting sling according to the invention

FIG. 3 shows a plan view of an endless lifting sling according to the invention. There can be seen the two-layer band 3, the single-layer overlapping regions 7, 7' with the weaving locations 5, 5', and the weaving locations 6, 6', which at the same time also represent the cutting places of the endless lifting sling 20.

Figure 4:
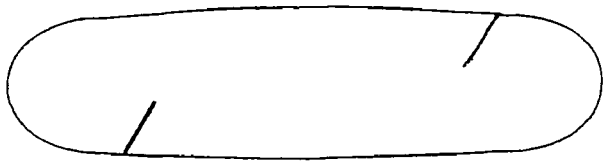
FIG. 4 shows a first embodiment example of an endless lifting sling

FIG. 4 shows a first embodiment example of an endless lifting sling with a breaking strength of 800 kg.

A 25 mm wide band of high strength polyester yarns was woven in two layers, with a width of 20 cm. The yarn strength was greater than 80 cN/tex. In the overlapping regions, the two layers were interwoven over a length of 2.5 cm.

Figure 5:
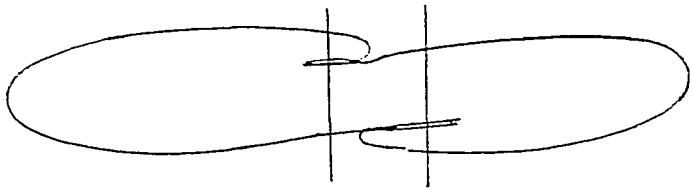
FIG. 5 shows a second embodiment example of a lifting sling as a binding strap

FIG. 5 shows a second embodiment example of a lifting sling as a binding strap for a ski binding, in plan view.

A 12 mm wide band of polyamide fibers was woven in two layers with a width of 22 cm. In the overlapping regions, the two layers were interwoven over a length of 1.5 cm. After the separation of the band, this was turned and additionally sewn in the overlapping regions. The result was a load bearing capacity of more than 200 daN.

Figure 6:
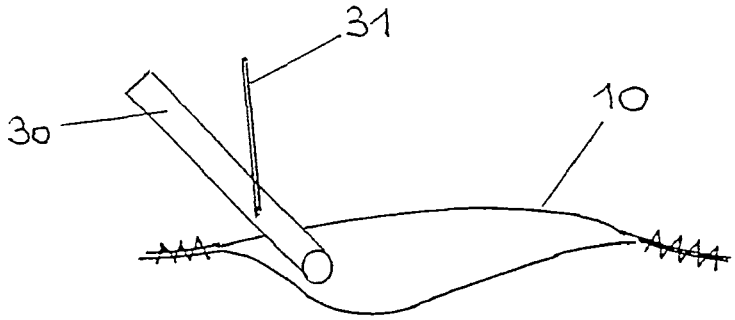
FIG. 6 shows a third embodiment example of a lifting sling with a stress element extrusion coated around it as a lashing strap

FIG. 6 shows an embodiment example of a lifting sling, with a stress element extrusion coated around it as a lashing strap. A lifting sling 10, which substantially corresponds to FIG. 4, is here designed for a load bearing capacity of 300 kg. It is now placed in an injection molding die with which a clamping element 30 with a clamp clip 31 of plastic can be extruded. The interwoven overlapping regions are 3.5 cm long.

Figure 7:
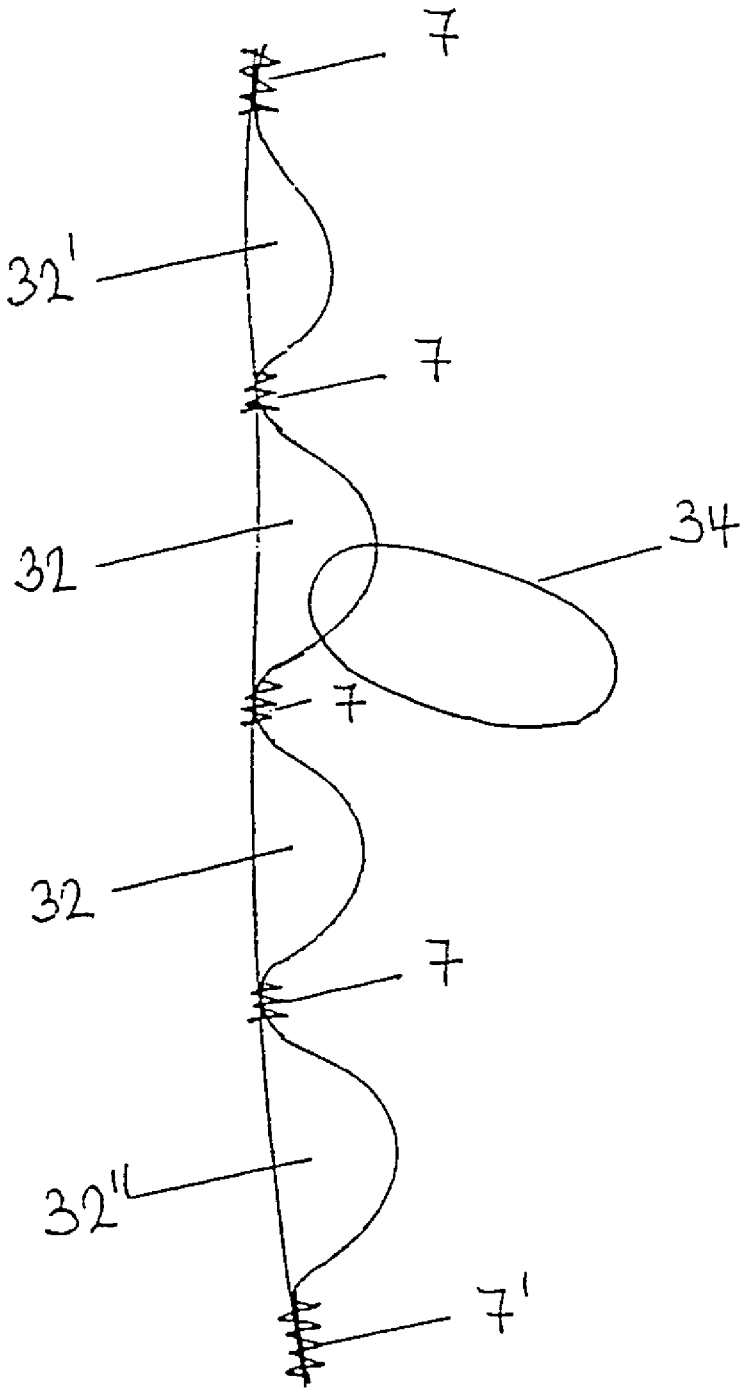
FIG. 7 shows a fourth embodiment example of a multiple arrangement of a lifting sling as a stop means or as connecting means.

FIG. 7 shows a fourth embodiment example of a multiple arrangement of a lifting sling as a materials sling, in plan view.

A 19 mm wide band of polyamide fibers is woven so that four openings 32, 32', 32" of 8 cm arise, respectively bounded by overlapping regions 7, 7'. The latter are respectively 18 mm long. A lifting sling of this kind is predominantly used for technical climbing, whereby the materials sling serves to receive carabiners 34 and similar equipment.

The invention claimed is:

1. A lifting sling for lifting loads, wherein the lifting sling comprises:

a first band and a second band and overlapping regions, the bands having ends leading into the overlapping regions; wherein the first band has a first warp yarn and the second band a second warp yarn, the first and second warp yarns forming with weft yarns a first and second weave; wherein the first and second warp yarns are brought together in the overlapping regions, where they form with the weft yarns a woven construction, to form a single band which has at least a further third weave that replaces the first and second weave in the overlapping region and which is different from the first and second weaves; and wherein the overlapping regions are cut at one end, the lifting sling being a part of a warp with warp yarns.

2. The lifting sling according to claim 1, wherein the overlapping regions are arranged mainly one above the other, so that a further overlapping region arises in which the lifting sling is sewn and forms a binding strap.

3. The lifting sling according to claim 1, wherein it is provided for insertion into an injection molding tool for a stress element, and wherein it forms an integral part of the stress element after an extrusion process has been completed.

4. The lifting sling according to claim 1, wherein it is present in a multiple arrangement, in which N overlapping regions form a number N−1 of lifting units, or form openings of which only the first and the last are cut.

5. The lifting sling according to claim 1, wherein a part of the warp yarns has a lower melting point than the remaining warp yarns, and wherein the interwoven overlapping regions are subsequently hot melt bonded whereby an increased strength results.

6. The lifting sling according to claim 1 configured as a binding strap.

7. The lifting sling according to claim 1 configured as a lashing strap.

8. Multiple lifting slings according to claim 1 configured as a multiple arrangement for technical climbing.

* * * * *